US009047816B2

(12) United States Patent
Oh

(10) Patent No.: US 9,047,816 B2
(45) Date of Patent: Jun. 2, 2015

(54) PIXEL AND ORGANIC LIGHT EMITTING DISPLAY DEVICE USING THE SAME

(75) Inventor: Choon-Yul Oh, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 1231 days.

(21) Appl. No.: 12/904,841

(22) Filed: Oct. 14, 2010

(65) Prior Publication Data

US 2011/0109598 A1 May 12, 2011

(30) Foreign Application Priority Data

Nov. 6, 2009 (KR) ..... 10-2009-0106917

(51) Int. Cl.
*G09G 3/30* (2006.01)
*G09G 3/32* (2006.01)

(52) U.S. Cl.
CPC ..... *G09G 3/3233* (2013.01); *G09G 3/3208* (2013.01); *G09G 3/3225* (2013.01); *G09G 2300/0819* (2013.01); *G09G 2300/0852* (2013.01); *G09G 2300/0861* (2013.01); *G09G 2320/043* (2013.01)

(58) Field of Classification Search
CPC .. G09G 3/3208; G09G 3/3225; G09G 3/3233
USPC ..... 345/76
See application file for complete search history.

(56) References Cited

U.S. PATENT DOCUMENTS

| | | | | |
|---|---|---|---|---|
| 7,408,533 | B2 * | 8/2008 | Eom et al. | 345/76 |
| 7,773,059 | B2 * | 8/2010 | Jeon et al. | 345/77 |
| 7,847,796 | B2 * | 12/2010 | Shin et al. | 345/210 |
| 8,310,419 | B2 * | 11/2012 | Woo et al. | 345/82 |
| 2005/0052377 | A1 * | 3/2005 | Hsueh | 345/82 |
| 2008/0172569 | A1 * | 7/2008 | Lee | 713/340 |
| 2010/0141645 | A1 * | 6/2010 | Choi et al. | 345/214 |

FOREIGN PATENT DOCUMENTS

| | | | |
|---|---|---|---|
| JP | 2005-099247 | A | 4/2005 |
| KR | 10-2005-0117368 | A | 12/2005 |
| KR | 10-2009-0016333 | A | 2/2009 |

OTHER PUBLICATIONS

Korean Office Action dated Apr. 20, 2011 for Korean Patent Application No. KR 10-2009-0106917 which corresponds to captioned U.S. Appl. No. 12/904,841.

* cited by examiner

*Primary Examiner* — Jonathan Boyd
(74) *Attorney, Agent, or Firm* — Knobbe, Martens, Olson & Bear, LLP

(57) ABSTRACT

A pixel for an organic light emitting display is disclosed. The pixel is configured to provide a current to an organic light emitting diode which is substantially independent of a voltage threshold of the driving transistor of the circuit.

20 Claims, 5 Drawing Sheets

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2009-0106917, filed on Nov. 6, 2009, in the Korean Intellectual Property Office, the entire content of which is incorporated herein by reference.

BACKGROUND

1. Field

The field relates to a pixel and an organic light emitting display device using the same and, more particularly, to a pixel and an organic light emitting display device that can display an image having uniform luminance.

2. Description of the Related Technology

Various flat panel display devices having reduced weight and volume when compared with a cathode ray tube have been developed. Examples of the flat panel display devices include a liquid crystal display device, a field emission display device, a plasma display panel, an organic light emitting display device, etc.

The organic light emitting device displays an image by using an organic light emitting diode that emits light by recombining holes with electrons. Such the organic light emitting display device has an advantage of being driven at low power consumption while having rapid response speed.

FIG. 1 is a circuit diagram showing a pixel of an organic light emitting display device.

Referring to FIG. 1, the pixel 4 of the organic light emitting display device includes an organic light emitting diode OLED and a pixel circuit 2 for controlling the organic light emitting diode OLED by being connected to a data line Dm and a scan line Sn.

An anode electrode of the organic light emitting diode OLED is connected to the pixel circuit 2 and a cathode electrode of the organic light emitting diode OLED is connected to second power ELVSS. The organic light emitting diode OLED generates light having luminance according to the amount of current supplied from the pixel circuit 2.

The pixel circuit 2 controls the amount of current supplied to the organic light emitting diode OLED according to a data signal supplied from the data line Dm when a scan signal is supplied to the scan line Sn. For this, the pixel circuit 2 includes a second transistor M2 connected between first power ELVDD and the organic light emitting diode OLED, a first transistor M1 connected between the second transistor M2, the data line Dm, and the scan line Sn, and a storage capacitor Cst connected between a gate electrode and a first electrode of the second transistor M2.

A gate electrode the first transistor M1 is connected to the scan line Sn and the first electrode of the first transistor M1 is connected to the data line Dm. In addition, a second electrode of the first transistor M1 is connected to one terminal of the storage capacitor Cst. Herein, the first electrode is either of a source electrode and a drain electrode and the second electrode is an electrode other than the first electrode. For example, when the first electrode is the source electrode, the second electrode is a drain electrode. The first transistor M1 connected to the scan line Sn and the data line Dm is turned on when the scan signal is supplied from the scan line Sn, such that the data signal supplied from the data line Dm is supplied to the storage capacitor Cst. At this time, the storage capacitor Cst is charged with voltage corresponding to the data signal.

The gate electrode of the second transistor M2 is connected to one terminal of the storage capacitor Cst and the first electrode of the second transistor M2 is connected to the other terminal of the storage capacitor Cst and to the first power supply ELVDD. In addition, a second electrode of the second transistor M2 is connected to the anode electrode of the organic light emitting diode OLED. The second transistor M2 controls the amount of current that flows to the second power ELVSS via the organic light emitting diode OLED from the first power ELVDD according to a voltage stored in the storage capacitor Cst. The organic light emitting diode OLED generates light corresponding to the amount of current supplied from the second transistor M2.

However, the pixel 4 of the organic light emitting display device of FIG. 1 cannot display an image having uniform luminance across many pixels. More specifically, threshold voltage of the second transistor M2 (driving transistor) included in each of the pixels 4 varies somewhat for each pixel 4 because of process deviation, and other effects. When the threshold voltage of the driving transistor varies among the pixels, even though a data signal corresponding to the same gray scale is supplied to the pixels, light having different luminances is generated by the pixels.

In order to solve the problem, there is proposed a structure in which transistors are additionally formed in each of the pixels 4 in order to compensate for the threshold voltage variation of the driving transistor. There are known pixels which use six transistors and one capacitor in each of the pixels 4 to compensate for threshold voltage variation. However, when six transistors are included in each of the pixels 4, the pixel 4 is complicated. In particular, malfunction probability is increased by the large number of transistors included in the pixels 4, such that a yield is deteriorated.

SUMMARY OF CERTAIN INVENTIVE ASPECTS

One aspect is a pixel, including an organic light emitting diode. The diode includes a cathode electrode connected to a second power. The pixel also includes a second transistor, including a first electrode connected with a first power, the second transistor configured to control an amount of current supplied to the organic light emitting diode from the first power. The pixel also includes a second capacitor and a first capacitor connected in series between a gate electrode of the second transistor and a ground power, and a first transistor connected to a first node between the second capacitor and the first capacitor and to a data line, the first transistor configured to be turned on when a scan signal is supplied to a scan line.

Another aspect is an organic light emitting display device. The display device includes a scan driver configured to sequentially supply a scan signal to scan lines, to supply an emission control signal to emission control lines, and to supply a control signal to control lines. The display device also includes a data driver configured to supply a third voltage to data lines during a first period of a period when the scan signal is supplied and to supply a data signal to the data lines during a second period different from the first period. The display device also includes a plurality of pixels positioned near intersections of the scan lines, the emission control lines, the control lines, and the data lines, where each of the pixels includes an organic light emitting diode, which includes a cathode electrode connected to a second power. The pixels also include a second transistor, having a first electrode connected with a first power, the second transistor configured to control an amount of current supplied to the organic light emitting diode from the first power. The pixels also include a second capacitor and a first capacitor connected in series between a gate electrode of the second transistor and a ground power, and a first transistor connected to a first node between the second capacitor and the first capacitor and to the data line, the first transistor configured to be turned on when the scan signal is supplied to the scan lines.

Another aspect is a pixel, including no more than three transistors connected between first and second power supplies, a plurality of capacitors connected to the transistors, and an organic light emitting diode, where the transistors and the capacitors are configured to supply a current to the organic light emitting diode, and where the current is substantially independent of a voltage threshold of any of the transistors.

BRIEF DESCRIPTION OF THE DRAWINGS

The accompanying drawings, together with the specification illustrate exemplary embodiments, and, together with the description, serve to explain the principles of the present invention.

DETAILED DESCRIPTION OF CERTAIN INVENTIVE EMBODIMENTS

Figure 1:
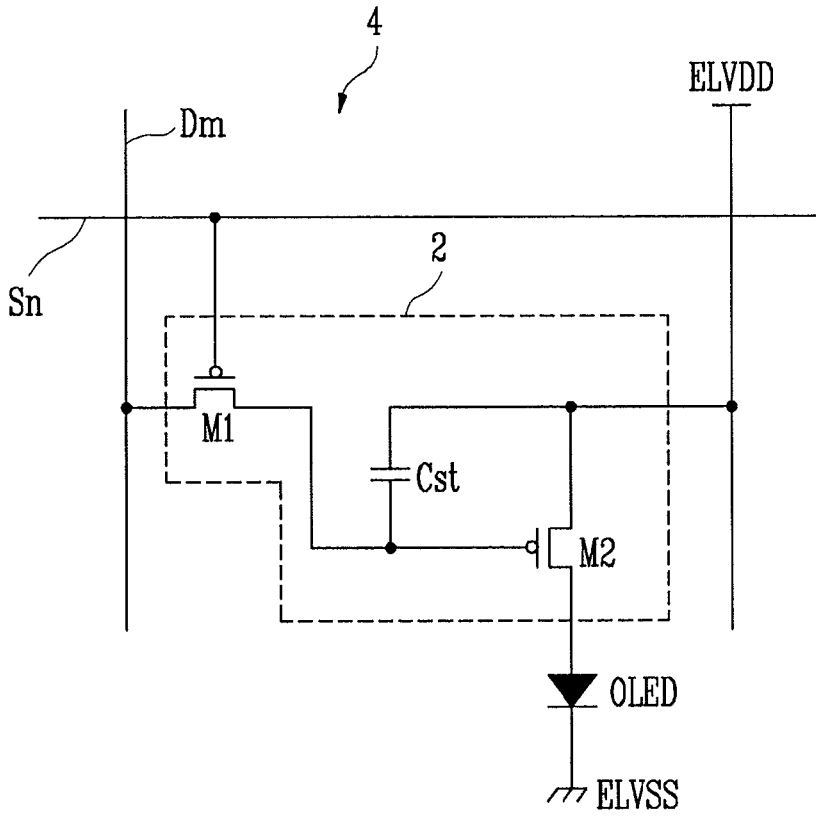
FIG. 1 is a circuit diagram showing a known pixel.

Hereinafter, certain exemplary embodiments will be described with reference to the accompanying drawings. Herein, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals generally refer to like elements throughout.

Hereinafter, embodiments will be described with reference to FIGS. 2 to 6.

Figure 2:
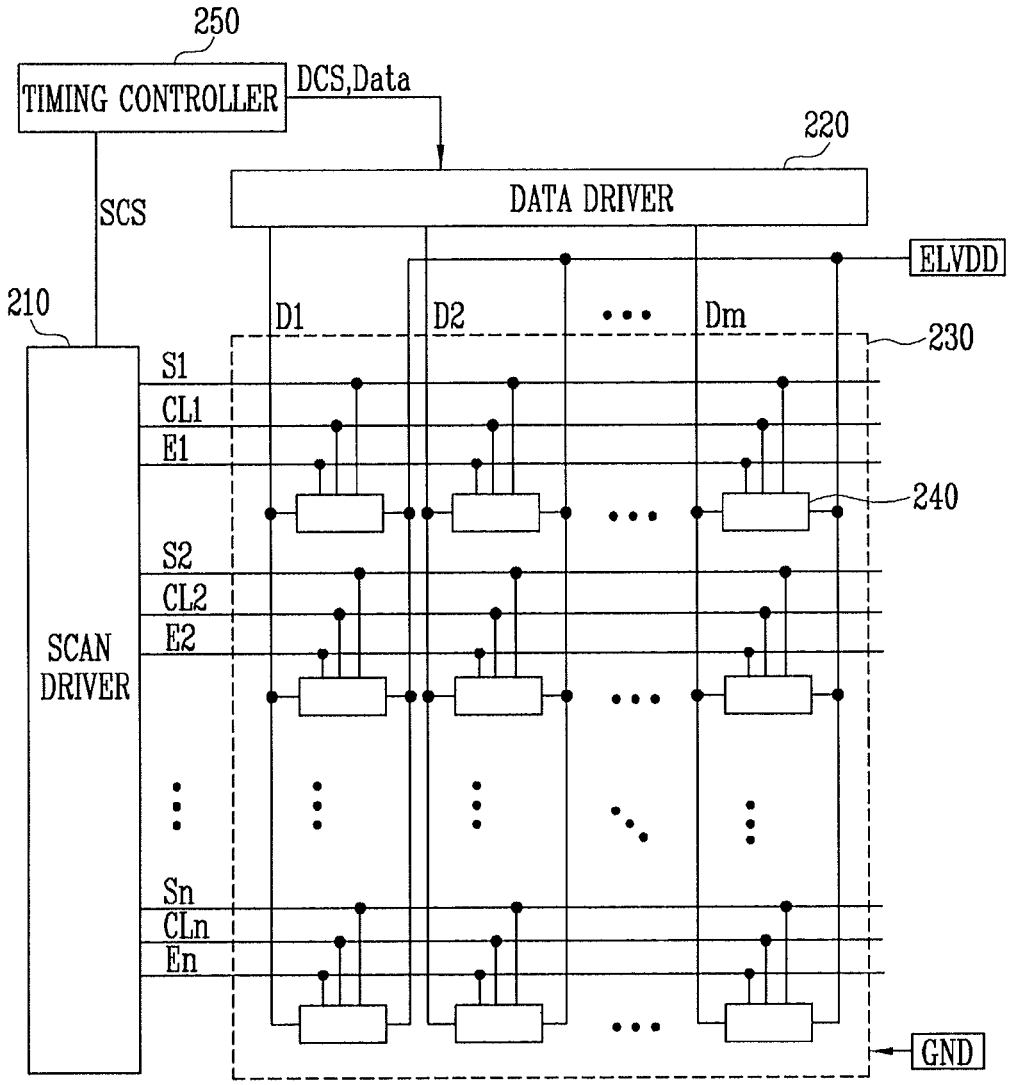
FIG. 2 is a diagram showing an organic light emitting display device according to an embodiment.

FIG. 2 is a diagram showing an organic light emitting display device according to an embodiment of the present invention.

Referring to FIG. 2, the organic light emitting display device includes a pixel unit 230 including pixels 240 that are positioned to connect scan lines S1 to Sn, control lines CL1 to CLn, emission control lines E1 to En, and data lines D1 to Dm, a scan driver 210 for driving the scan lines S1 to Sn, the emission control lines E1 to En, and the control lines CL1 to CLn, a data driver 220 for driving the data line D1 to Dm, and a timing controller 250 for controlling the scan driver 210 and the data driver 220.

The scan driver 210 receives a scan driving control signal SCS from the timing controller 250. Further, the scan driver 210 receiving the scan driving control signal SCS generates a scan signal and sequentially supplies the generated scan signal to the scan lines S1 to Sn. Further, the scan driver 210 generates a control signal in response to the scan driving control signal SCS and sequentially supplies the generated control signal to the control lines CL1 to CLn Likewise, the scan driver 210 generates an emission control signal and sequentially the emission control signal to the emission control lines E1 to En.

Figure 4:
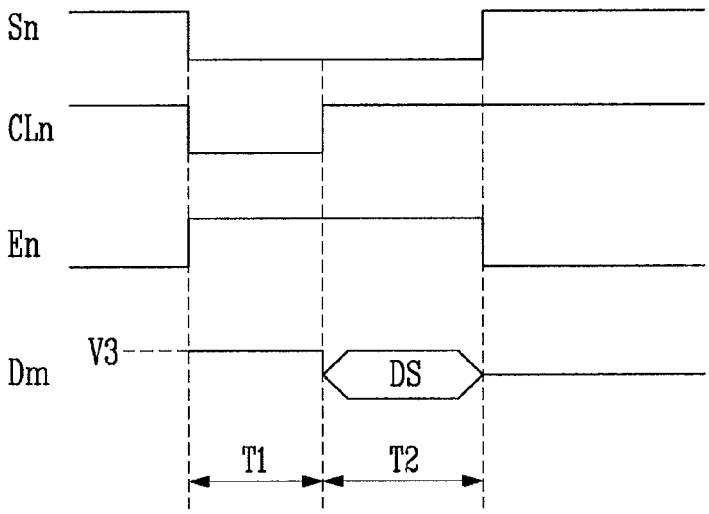
FIG. 4 is a waveform diagram showing a driving method of a pixel shown in FIG. 3.

A scan signal supplied to an i-th scan line Si is supplied during a first period T1 and a second period T2 of a horizontal period and a control signal supplied to an i-th control line CLi is supplied during the first period T1 as shown in FIG. 4. Further, an emission control signal supplied to an i-th emission control line Ei is supplied while the scan signal is supplied to the i-th scan line Si. The scan signal and the control signal are set to a voltage (e.g., low voltage) at which a transistor receiving a signal can be turned on and the emission control signal is set to voltage (e.g., high voltage) at which a transistor receiving a signal can be turned off.

The scan driver 220 receives a data driving control signal DCS from the timing controller 250. The data driver 220 receiving the data driving control signal DCS generates a data signal and supplies the generated data signal to the data lines D1 to Dm so as to be synchronized with the scan signal. The data driver 220 supplies a third voltage V3 to the data lines D1 to Dm during the first period T1 and supplies a data signal DS during the second period T2 as shown in FIG. 4. The third voltage V3 may, for example, be set as a voltage for determining a gray scale, which is equal to or higher than the data signal.

The timing controller 250 generates the data driving signal DCS and the scan driving control signal SCS to correspond to synchronization signals (not shown) supplied thereto. The data driving control signal DCS generated by the timing controller 250 is supplied to the data driver 220 and the scan driving control signal SCS is supplied to the scan driver 210. In addition, the timing controller 250 supplies data Data supplied to the data driver 220.

The pixel unit 230 receives and supplies ground power GND and first power ELVDD to the pixels 240. The pixels 240 receiving the ground power GND and the first power ELVDD generate light having luminance corresponding to a difference between the third voltage V3 and the voltage of the data signal.

Figure 3:
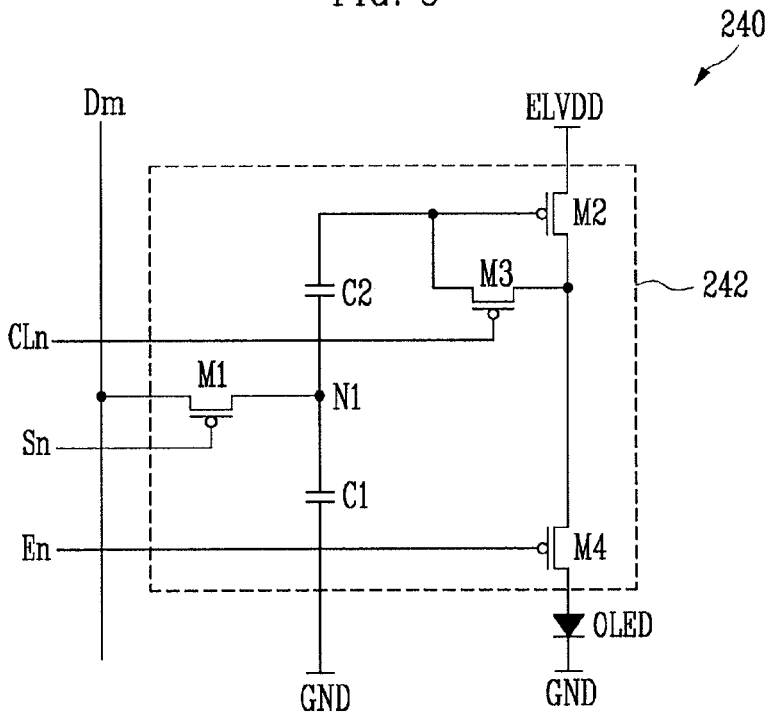
FIG. 3 is a circuit diagram showing an embodiment of a pixel shown in FIG. 2.

FIG. 3 is a diagram showing an embodiment of a pixel shown in FIG. 2. In FIG. 3, a pixel connected to the n-th scan line Sn and the m-th data line Dm is shown for convenience of description.

Referring to FIG. 3, the pixel 240 includes the organic light emitting diode OLED and a pixel circuit 242 that is connected to the data line Dm, the scan line Sn, the emission control line En, and the control line CLn to control the amount of current supplied to the organic light emitting diode OLED.

An anode electrode of the organic light emitting diode OLED is connected to a pixel circuit 242 and a cathode electrode of the organic light emitting diode OLED is connected to the ground power GND. The organic light emitting diode OLED generates light having luminance corresponding to the amount of current supplied from the pixel circuit 242.

The pixel circuit 242 controls the amount of current to the ground power GND from the first power ELVDD via the organic light emitting diode OLED. For this, the pixel circuit 242 includes first to fourth transistors M1 to M4, a first capacitor C1, and a second capacitor C2.

A first electrode of the first transistor M1 is connected to the data line Dm and a second electrode of the first transistor M1 is connected to a first node N1. In addition, a gate electrode of the first transistor M1 is connected to the scan line Sn. The first transistor M1 is turned on when the scan signal is supplied to the scan line Sn to supply the third voltage V3 and the data signal DS from the data line Dm to the first node N1.

A first electrode of the second transistor M2 is connected to the first power ELVDD and a second electrode of the second transistor M2 is connected to a first electrode of the fourth transistor M4. In addition, the gate electrode of the second transistor M2 is connected to a first terminal of the second capacitor C2. The second transistor M2 controls the amount of current supplied to the organic light emitting diode OLED according to voltage applied to the gate electrode thereof.

A first electrode of the third transistor M3 is connected to the second electrode of the second transistor M2 and a second electrode of the third transistor M3 is connected to the gate electrode of the second transistor M2. In addition, a gate electrode of the third transistor M3 is connected to the control line CLn. The third transistor M3 is turned on when the control signal is supplied to the control line CLn to diode connect the second transistor M2.

A first electrode of the fourth transistor M4 is connected to the second electrode of the second transistor M2 and a second electrode of the fourth transistor M4 is connected to the anode electrode of the organic light emitting diode OLED. In addition, a gate electrode of the fourth transistor M4 is connected to the emission control line En. The fourth transistor M4 is turned off when the emission control signal is supplied to the emission control line En and turned off when the emission control signal is not supplied. In this case, the fourth transistor M4 is turned on and off alternately with the first transistor.

The first capacitor C1 is connected between the first node N1 an the ground power GND. The first capacitor C1 is charged with a voltage corresponding to the data signal.

The second capacitor C2 is connected between the first node N1 and the gate electrode of the second transistor M2. The second capacitor C2 is charged with a voltage corresponding to threshold voltage of the second transistor M2.

FIG. 4 is a waveform diagram showing a driving method of a pixel shown in FIG. 3.

As shown in FIG. 4, a low scan signal is supplied to the scan line Sn and a low control signal is supplied to the control line CLn during the first period T1. In addition, a high emission control signal is supplied to the emission control line En during the first period T1.

Figure 5A:
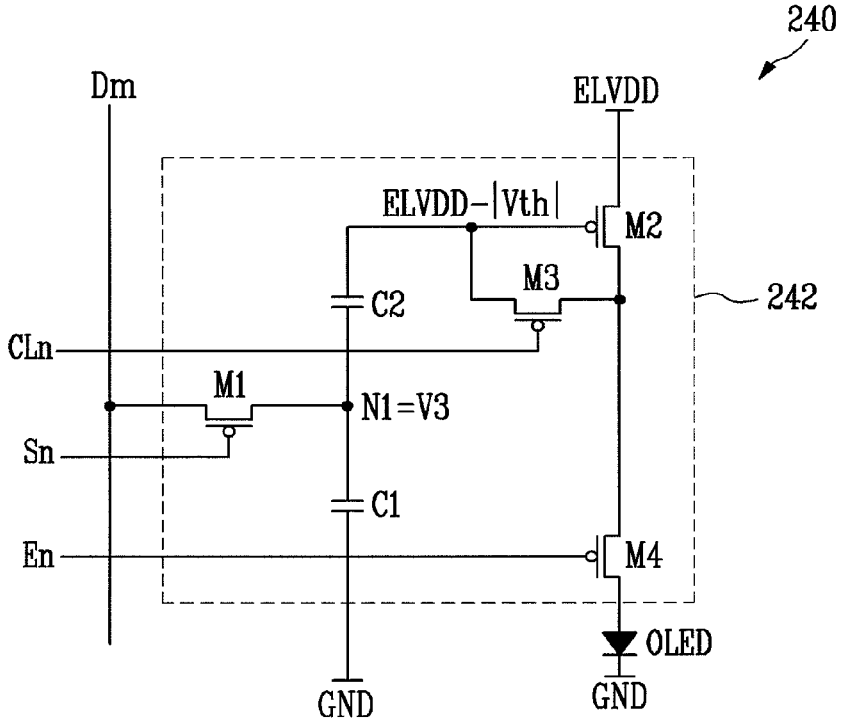
FIGS. 5A to 5C are diagrams showing a driving process corresponding to a waveform diagram of FIG. 4.

When the high emission control signal is supplied to the emission control line En, the fourth transistor M4 is turned off as shown in FIG. 5A. When the low scan signal is supplied to the scan line Sn, the first transistor M1 is turned on and when the low control signal is supplied to the control line CLn, the third transistor M3 is turned on.

When the first transistor M1 is turned on, the third voltage V3 from the data line Dm is supplied to the first node N1 during the first period T1. When the third transistor M3 is turned on, the second transistor M2 is diode connected. In this case, a voltage substantially equal to the first power ELVDD minus the threshold voltage of the second transistor M2 is applied to the gate electrode of the second transistor M2. Therefore, during the first period T1, the second capacitor C2 is charged with voltage shown in Equation 1.

$$VC2=ELVDD-|Vth|-V3 \quad \text{[Equation 1]}$$

In Equation 1, VC2 represents the voltage charged in the second capacitor C2. Referring to Equation 1, during the first period T1, the second capacitor C2 is charged with the voltage corresponding to the threshold voltage of the second transistor M2.

During the second period T2, a high control signal is supplied to the control line CLn. In addition, during the second period T2, a low scan signal and a low emission control signal are supplied to the scan line Sn and the emission control line En, respectively.

Figure 5B:
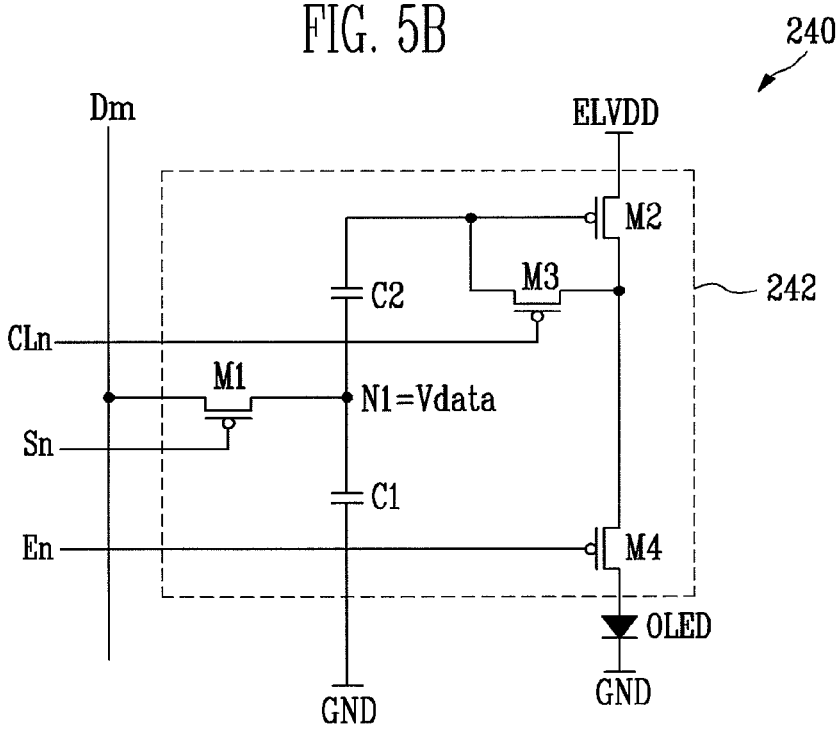

Because the control signal is high, the third transistor M3 is off as shown in FIG. 5B. Accordingly, the second capacitor C2 is not driven. Because the low scan signal is supplied to the scan line Sn, the first transistor M1 maintains a turn-on state. Because the first transistor M1 is turned on, the data signal DS from the data line Dm is supplied to the first node N1 during the second period T2. In this case, the voltage Vdata corresponding to the data signal DS is applied to the first node N1.

Because the first terminal of the second capacitor is not otherwise driven, when the voltage Vdata of the data signal is applied to the first node N1, the second capacitor C2 maintains the voltage charged during the first period.

Therefore, during the second period T2, voltage VM2_g applied to the gate electrode of the second transistor M2 is determined as shown in Equation 2.

$$\begin{aligned} VM2_g &= Vdata + VC2 \\ &= Vdata + ELVDD - |Vth| - V3 \end{aligned} \quad \text{[Equation 2]}$$

In addition, during the second period T2, the first capacitor C1 is charged with voltage equal to voltage Vdata.

Figure 5C:
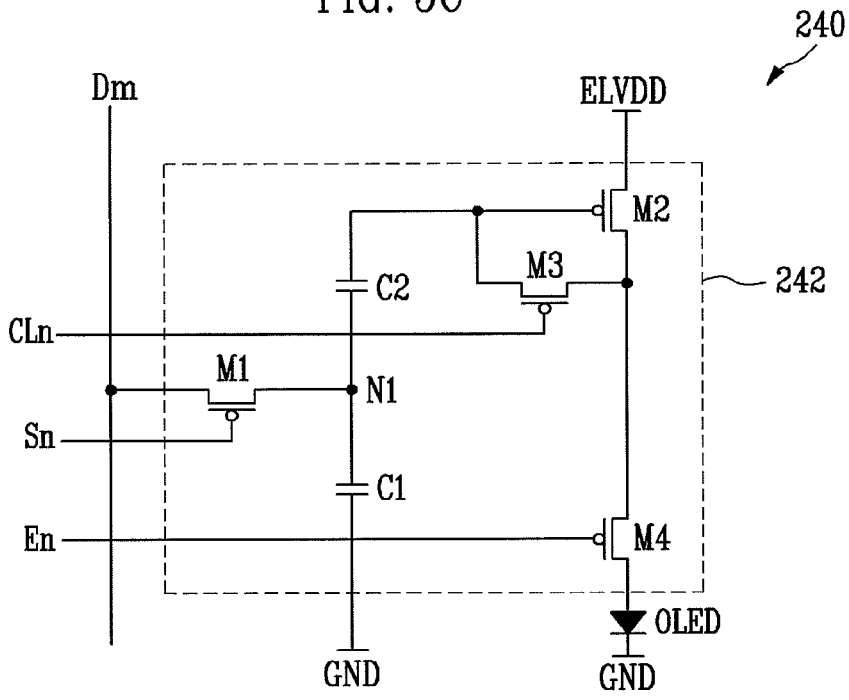

After the second period T2, a high scan signal and a low emission control signal are supplied to the scan line Sn and the emission control line En, respectively. Accordingly, the first transistor M1 is turned off and the fourth transistor M4 is turned on as shown in FIG. 5C.

When the fourth transistor M4 is turned on, the second electrode of the second transistor M2 and the anode electrode of the organic light emitting diode OLED are electrically connected to each other. Accordingly, the second transistor M2 supplies current corresponding to voltage applied to its gate to the organic light emitting diode OLED. That is, the second transistor M2 supplies current corresponding to Equation 3 to the organic light emitting diode OLED.

$$\begin{aligned} I &= \beta/2(ELVDD - VM2_g - |Vth|)^2 \\ &= \beta/2(ELVDD - Vdata - ELVDD + |Vth| + V3 - |Vth|)^2 \\ &= \beta/2(-Vdata + V3)^2 \end{aligned} \quad \text{[Equation 3]}$$

In Equation 3, I represents current that flows to the organic light emitting diode OLED. Referring to Equation 3, the current that flows to the organic light emitting diode OLED is independent of the threshold voltage of the second transistor M2. That is, it is possible to display the image having the uniform luminance regardless of a deviation in threshold voltage of the second transistors M2 of the multiple pixels.

Further, in the embodiment of the present invention, the current that flows on the organic light emitting diode OLED is determined by the voltage difference between the third voltage V3 and the voltage Vdata of the data signal, and is independent of the first power ELVDD. Therefore, it is possible to display an image having desired luminance regardless of the voltage drop of the first power ELVDD.

As shown, the cathode electrode of the organic light emitting diode OLED is connected to the ground power GND, not a negative voltage supply. As such, a component for generating a negative voltage is not needed in a power supply unit, such that it is possible to save the manufacturing cost.

As an example, when the third voltage V3 is 4V, the threshold voltage of the second transistor M2 is 2V, the first power ELVDD is 10V, and the voltage Vdata of the data signal is 2V, the voltage applied to the gate electrode of the second transistor M2 is a voltage lower than the first power ELVDD. Accordingly the pixel stably supplies the current to the organic light emitting diode OLED. In addition, because the second terminal of the first capacitor C1 is connected to the ground power GND, and the cathode electrode of the organic light emitting diode OLED is connected to the ground power GND, the data driver 220 does not need to be referenced to a negative voltage and can advantageously be referenced to ground power GND.

Figure 6:
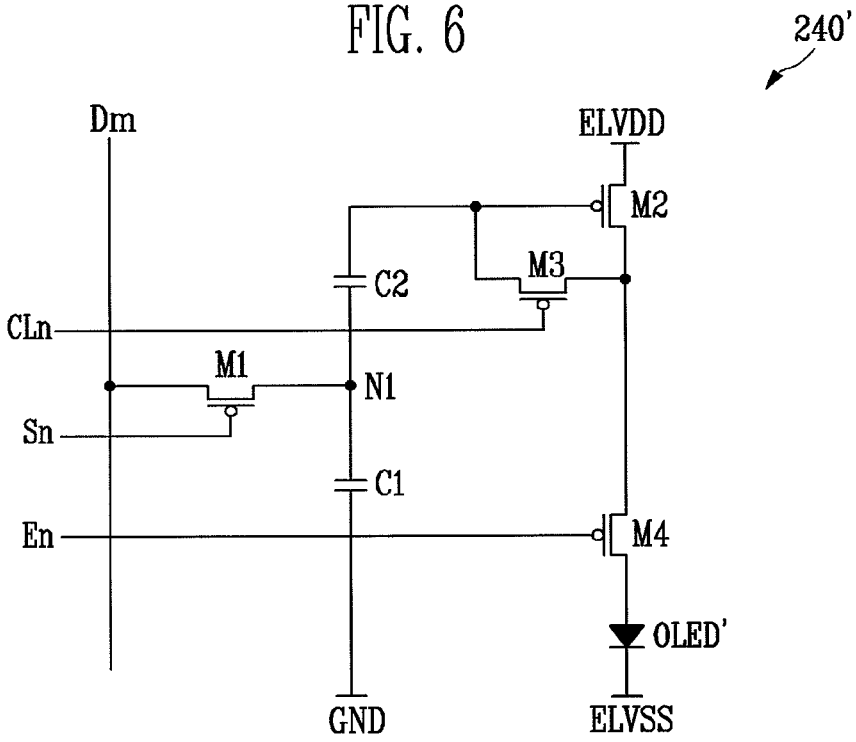
FIG. 6 is a circuit diagram showing another embodiment of a pixel shown in FIG. 2.

FIG. 6 is a diagram showing a pixel according to another embodiment.

Referring to FIG. 6, in the pixel 240', a cathode electrode of an organic light emitting diode OLED' is connected to second power ELVSS which is negative voltage. That is, the cathode electrode of the organic light emitting diode OLED' can be connected to either the ground power GND or to the second power ELVSS, with stable driving. When the cathode electrode of the organic light emitting diode OLED' is connected to the second power ELVSS which is the negative voltage, it is possible to implement an image having brighter luminance that that achieved with the cathode electrode connected to the ground power GND. The operation process of the pixel 240' is similar to that of pixel 240 of FIGS. 5A-5C.

While the present invention has been described in connection with certain exemplary embodiments, it is to be understood that the invention is not limited to the disclosed embodiments, but, on the contrary, is intended to cover various modifications and equivalent arrangements.

What is claimed is:

1. A pixel, comprising:

an organic light emitting diode, comprising a cathode electrode connected to a second power;

a second transistor, comprising a first electrode connected with a first power, the second transistor configured to control an amount of current supplied to the organic light emitting diode from the first power;

a second capacitor and a first capacitor connected in series between a gate electrode of the second transistor and a ground power; and a first transistor connected to a first node between the second capacitor and the first capacitor and to a data line, wherein the first transistor is configured to i) be turned on when a scan signal is supplied to a scan line and ii) transmit a third voltage to the first node and wherein the third voltage is different from the voltage of the first power and a data voltage.

2. The pixel of claim 1, further comprising:

a third transistor connected to a gate electrode and to a second electrode of the second transistor, the third transistor configured to be on during a part of a period when the first transistor is on.

3. The pixel of claim 2, wherein a horizontal period is divided into a first period and a second period, and the first transistor is configured to be on during a first period and a second period and the third transistor is configured to be on during the first period.

4. The pixel of claim 1, further comprising:

a fourth transistor connected between a second electrode of the second transistor and the organic light emitting diode and is configured to be turned on and turned off alternately with the first transistor.

5. The pixel of claim 1, wherein the second power is the ground power.

6. The pixel of claim 1, wherein the second power is a negative voltage.

7. The pixel of claim 1, wherein the first transistor is configured to transmit the third voltage to the first node during a first period.

8. The pixel of claim 7, wherein the first transistor is configured to transmit the data voltage to the first node during a second period.

9. The pixel of claim 8, wherein the third voltage is higher than the data voltage.

10. An organic light emitting display device, comprising:

a scan driver configured to sequentially supply a scan signal to scan lines, to supply an emission control signal to emission control lines, and to supply a control signal to control lines;

a data driver configured to supply a third voltage to data lines during a first period of a period when the scan signal is supplied and to supply a data signal to the data lines during a second period different from the first period; and a plurality of pixels positioned near intersections of the scan lines, the emission control lines, the control lines, and the data lines, wherein each of the pixels comprises:

an organic light emitting diode, comprising a cathode electrode connected to a second power;

a second transistor, comprising a first electrode connected with a first power, the second transistor configured to control an amount of current supplied to the organic light emitting diode from the first power;

a second capacitor and a first capacitor connected in series between a gate electrode of the second transistor and a ground power; and a first transistor connected to a first node between the second capacitor and the first capacitor and to the data line, the first transistor configured to be turned on when the scan signal is supplied to the scan lines, wherein the third voltage is different from the voltage of the first power and the data signal.

11. The organic light emitting display device of claim 10, wherein the scan driver is configured to supply the scan signal to an i-th scan line during the first period and during the second period to turn on the first transistor and to supply the control signal to an i-th control line during the first period to turn on the third transistor, wherein i is a natural number.

12. The organic light emitting display device of claim 11, wherein the scan driver is configured to supply the emission control signal to the i-th emission control line during the first period and during the second period to turn off the fourth transistor.

13. The organic light emitting display device of claim 11, wherein the pixel comprises a third transistor connected to a gate electrode and to a second electrode of the second transistor, the third transistor configured to be according to the control signal is supplied to the control lines.

14. The organic light emitting display device of claim 12, wherein the pixel further comprises a fourth transistor connected between the second electrode of the second transistor and the organic light emitting diode, and is turned off according to the emission control signal supplied to the emission control lines.

15. The organic light emitting display device of claim 10, wherein the second power is the ground power.

16. The organic light emitting display device of claim 10, wherein the second power has a negative voltage.

17. The organic light emitting display device of claim 10, wherein the third voltage has a voltage equal to or higher than the voltage of the data signal.

18. A pixel, comprising:

no more than four transistors connected between first and second power supplies;

a plurality of capacitors connected to the transistors; and an organic light emitting diode, connected to at least one of the transistors, wherein the transistors and the capacitors are configured to: i) supply a current to the organic light emitting diode based on a data voltage received from a data line, ii) receive a luminance selection voltage different from the voltage of first power supply and the data voltage and iii) supply the luminance selection voltage to at least one of the capacitors, and wherein the current is substantially independent of a voltage threshold of any of the transistors.

19. The pixel of claim 18, wherein the current is substantially independent of the voltage of the first power supply.

20. The pixel of claim 18, wherein the current is substantially independent of the voltage of the first power and second supplies.

* * * * *